US008676102B2

(12) United States Patent
Hiramatsu

(10) Patent No.: US 8,676,102 B2
(45) Date of Patent: Mar. 18, 2014

(54) FIXING DEVICE HAVING TEMPERATURE DETECTION ELEMENT

(75) Inventor: Seiji Hiramatsu, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 286 days.

(21) Appl. No.: 13/040,997

(22) Filed: Mar. 4, 2011

(65) Prior Publication Data

US 2011/0318074 A1 Dec. 29, 2011

(30) Foreign Application Priority Data

Jun. 29, 2010 (JP) ..... 2010-147229

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS

| | | | | |
|---|---|---|---|---|
| 3,811,828 | A * | 5/1974 | Ohta et al. | 432/227 |
| 4,438,321 | A * | 3/1984 | Moraw | 219/216 |
| 4,934,831 | A * | 6/1990 | Volbrecht | 374/183 |
| 5,051,784 | A * | 9/1991 | Yamamoto et al. | 399/329 |
| 5,115,278 | A * | 5/1992 | Maruta et al. | 399/329 |
| 5,278,618 | A * | 1/1994 | Mitani et al. | 399/329 |
| 5,386,281 | A * | 1/1995 | Mitani et al. | 399/329 |
| 5,499,087 | A * | 3/1996 | Hiraoka et al. | 399/329 |
| 5,660,750 | A * | 8/1997 | Kusaka | 219/216 |
| 6,049,064 | A * | 4/2000 | Natsuhara et al. | 219/216 |
| 6,339,211 | B1 * | 1/2002 | Foote et al. | 219/216 |
| 7,792,451 | B2 * | 9/2010 | Kim et al. | 399/69 |
| 2005/0265758 | A1 * | 12/2005 | Haseba et al. | 399/329 |
| 2006/0051117 | A1 * | 3/2006 | Nishida | 399/69 |
| 2007/0065168 | A1 * | 3/2007 | Coleman et al. | 399/70 |
| 2007/0116481 | A1 * | 5/2007 | Mochizuki et al. | 399/33 |
| 2009/0232534 | A1 * | 9/2009 | Haseba et al. | 399/69 |
| 2009/0257794 | A1 * | 10/2009 | Kaino et al. | 399/329 |
| 2011/0082260 | A1 * | 4/2011 | Omata et al. | 525/276 |
| 2011/0103853 | A1 * | 5/2011 | Creteau et al. | 399/329 |
| 2011/0158719 | A1 * | 6/2011 | Miyauchi et al. | 399/329 |
| 2011/0164906 | A1 * | 7/2011 | Ishida et al. | 399/329 |
| 2012/0008971 | A1 * | 1/2012 | Lee et al. | 399/69 |

FOREIGN PATENT DOCUMENTS

| | | |
|---|---|---|
| JP | 2004-094146 A | 3/2004 |
| JP | 2006-033170 | 2/2006 |
| JP | 2006-251479 | 9/2006 |

OTHER PUBLICATIONS

Japanese Office Action mailed Jan, 7, 2014, JP Appln. 2010-147229, English translation.

* cited by examiner

*Primary Examiner* — David Bolduc
(74) *Attorney, Agent, or Firm* — Banner & Witcoff, Ltd.

(57) ABSTRACT

A fixing device for thermally fixing a developing agent image to a sheet includes: a flexible fusing member; a heater; a nip member; a backup member; and a temperature detection element. The flexible fusing member has an inner peripheral surface defining an internal space. The heater is disposed in the internal space and radiates radiant heat. The nip member is disposed in the internal space and receives the radiant heat from the heater. The inner peripheral surface is in sliding contact with the nip member. The backup member provides a nip region in cooperation with the fusing member upon nipping the fusing member between the backup and nip members. The backup member confronts the nip member in a confronting direction. The temperature detection element is disposed in a superposed region of the nip member superposed with the nip region in the confronting direction and detects a temperature of the region.

8 Claims, 7 Drawing Sheets

FIXING DEVICE HAVING TEMPERATURE DETECTION ELEMENT

CROSS REFERENCE TO RELATED APPLICATION

This application claims priority from Japanese Patent Application No. 2010-147229 filed Jun. 29, 2010. The entire content of the priority application is incorporated herein by reference.

TECHNICAL FIELD

The present invention relates to a fixing device provided with a temperature detection element.

BACKGROUND

A conventional thermal fixing device for an electro-photographic type image forming device includes a tubular fusing film, a heater disposed in an internal space of the fusing film, a pressure roller, and a nip plate defining a nip region relative to the pressure roller through the fusing film. Further, the fixing device includes a temperature detection element for detecting a temperature of the fusing film. The temperature detection element is disposed at a recessed portion formed in the nip plate and positioned upstream of the nip region. In this fixing device, detection of the temperature of the fusing film enables a temperature of the nip region to be maintained at a predetermined fixing temperature.

SUMMARY

However, in such a fixing device, the temperature detection element is disposed outside of the nip region. Hence, it is difficult to accurately detect and control the temperature of the nip region. In view of the foregoing, it is an object of the present invention to provide a fixing device capable of accurately detecting a temperature of a region of a nip plate superposed with a nip region.

In order to attain the above and other objects, the present invention provides a fixing device for thermally fixing a developing agent image to a sheet fed in a sheet feeding direction including: a tubular flexible fusing member; a heater; a nip member; a backup member; and a temperature detection element. The tubular flexible fusing member has an inner peripheral surface defining an internal space. The heater is disposed in the internal space and configured to radiate radiant heat. The nip member is disposed in the internal space and configured to receive the radiant heat from the heater. The inner peripheral surface is in sliding contact with the nip member. The backup member is configured to provide a nip region in cooperation with the fusing member upon nipping the fusing member between the backup member and the nip member. The backup member confronts the nip member in a confronting direction. The temperature detection element is disposed in a superposed region of the nip member superposed with the nip region in the confronting direction and configured to detect a temperature of the superposed region.

DETAILED DESCRIPTION

Figure 1:
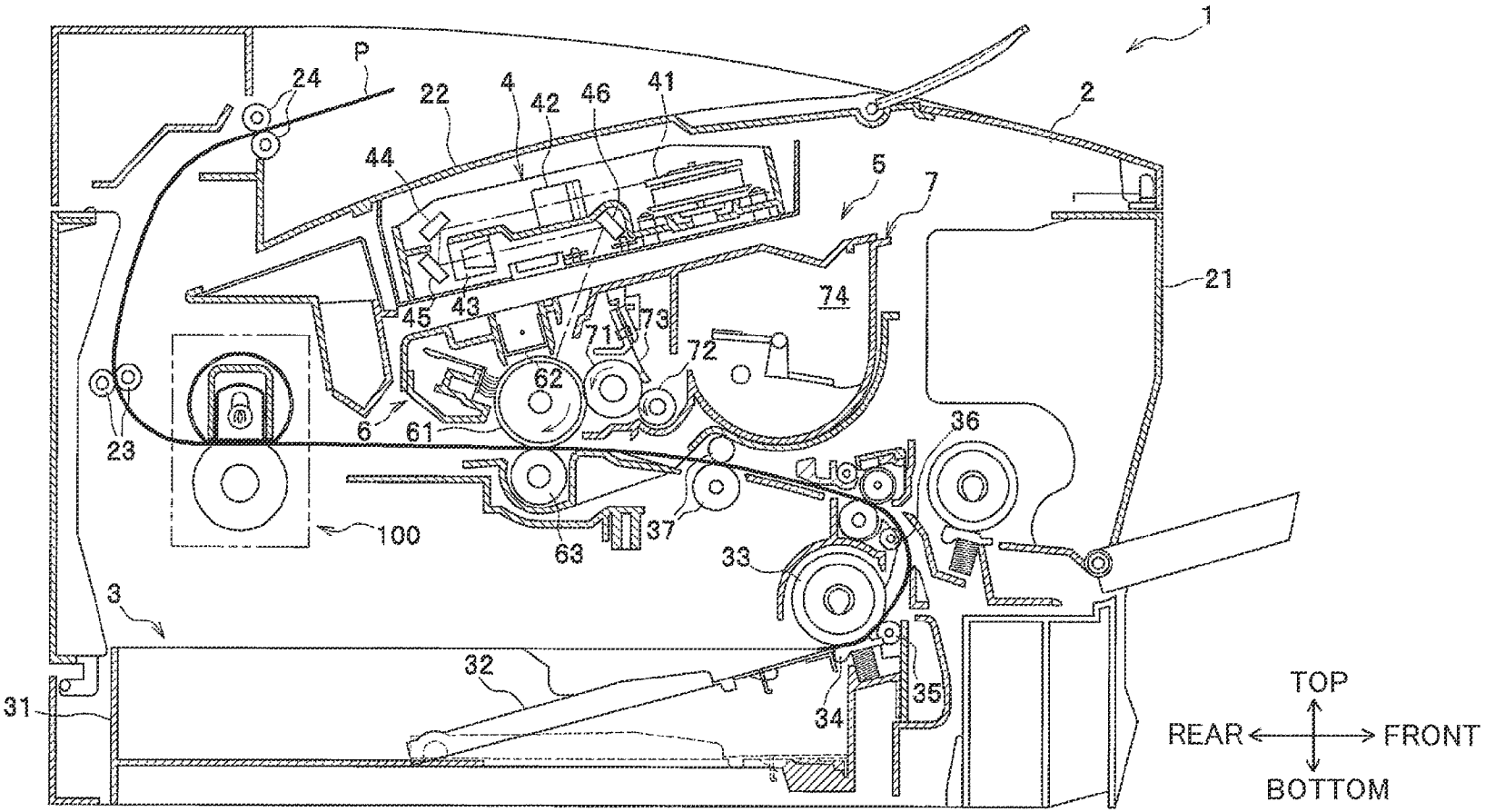
FIG. 1 is a schematic cross-sectional view showing a structure of a laser printer having a fixing device according to one embodiment of the present invention.

Next, a general structure of a laser printer as an image forming device will be described with reference to FIG. 1. The laser printer 1 shown in FIG. 1 is provided with a fixing device 100 according to one embodiment of the present invention. A detailed structure of the fixing device 100 will be described later while referring to FIGS. 2 to 5.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a rotatably driven polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
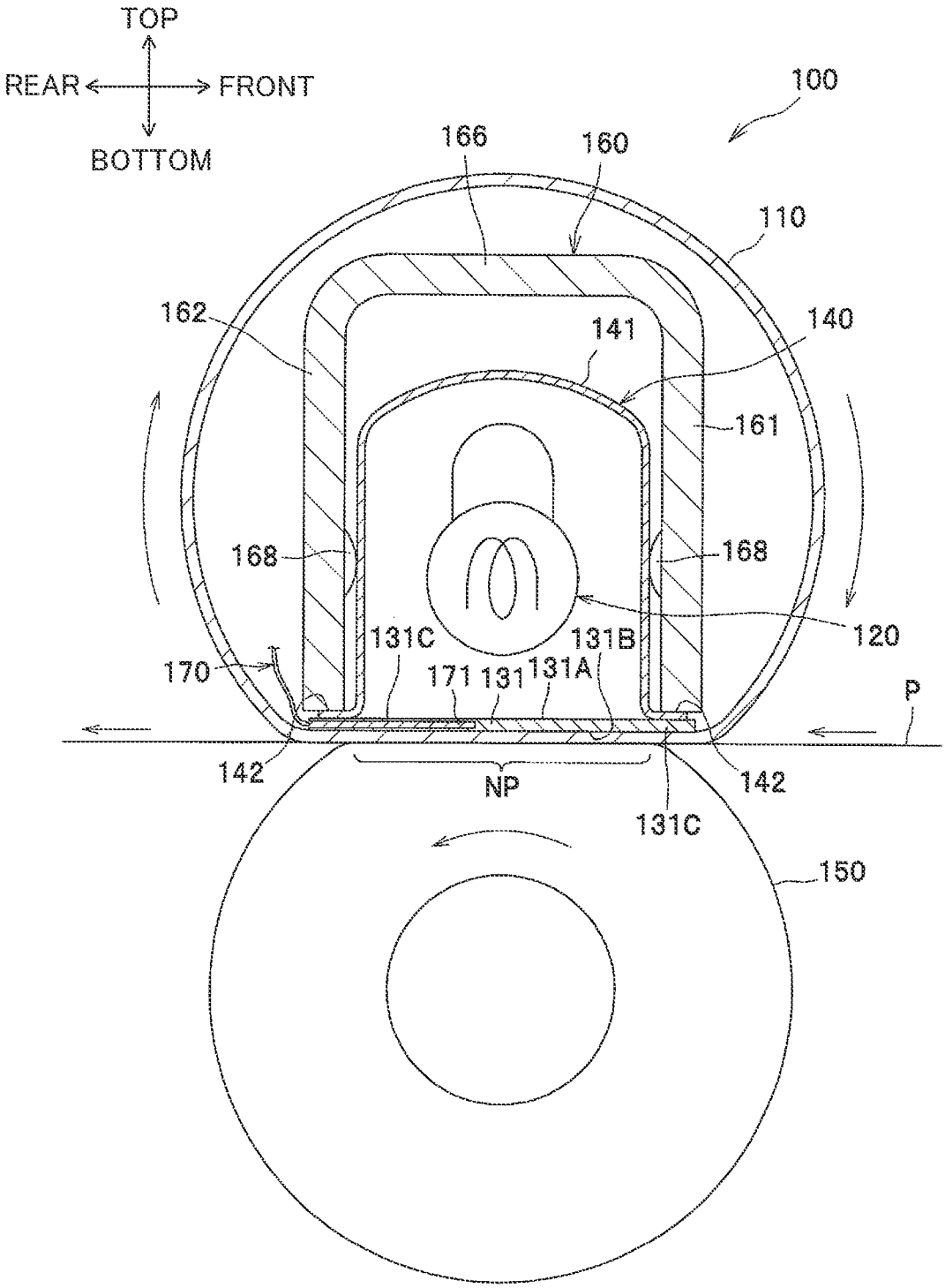
FIG. 2 is a schematic cross-sectional view showing a structure of the fixing device according to the embodiment.

As shown in FIG. 2, the fixing device 100 includes a flexible tubular fusing member such as a tube or film 110, a halogen lamp 120, a nip plate 131 as a nip member, a reflection plate 140, a pressure roller 150 as a backup member, and a stay 160.

In the following description, a direction such that the sheet P is fed will be simply referred to as "sheet feeding direction". A direction such that the nip plate 131 confronts the pressure roller 150 will be simply referred to as "confronting direction". A lateral or rightward/leftward direction will be simply referred to as "widthwise direction" of the sheet P.

The fusing film 110 is of a tubular (endless) configuration having heat resistivity and flexibility. Each widthwise (right and left) end portion of the fusing film 110 is guided by a guide member (not shown) fixed to a frame (not shown) of the fixing device 100 so that the fusing film 110 is circularly movable. The fusing film 110 has an inner peripheral surface in sliding contact with the nip plate 131 through grease. Incidentally, the grease is not necessarily applied to the inner peripheral surface of the fusing film 110 depending on materials of the fusing film 110 and the nip plate 131.

The halogen lamp 120 is a heater to heat the nip plate 131 and the fusing film 110 for heating toner on the sheet P. The halogen lamp 120 is positioned at an internal space of the fusing film 110 and is spaced away from the inner peripheral surface of the fusing film 110 as well as from an inner surface of the nip plate 131 by a predetermined distance.

The nip plate 131 is adapted for receiving pressure from the pressure roller 150 and for receiving radiant heat from the halogen lamp 120. The nip plate 131 transmits radiant heat from the halogen lamp 120 to the toner on the sheet P through the fusing film 110. To this effect, the nip plate 131 is positioned such that the inner peripheral surface of the fusing film 110 is moved slidably therewith through grease.

The nip plate 131 is formed in a flat plate shape and made from a material such as aluminum having a thermal conductivity higher than that of the stay 160 (described later) made of steel. The nip plate 131 has an upper surface 131A, a lower surface 131B, and front and rear end portions 131C. The upper surface 131A may be painted with a black color or provided with a heat absorbing member so as to efficiently absorb radiant heat from the halogen lamp 120.

Figure 3:
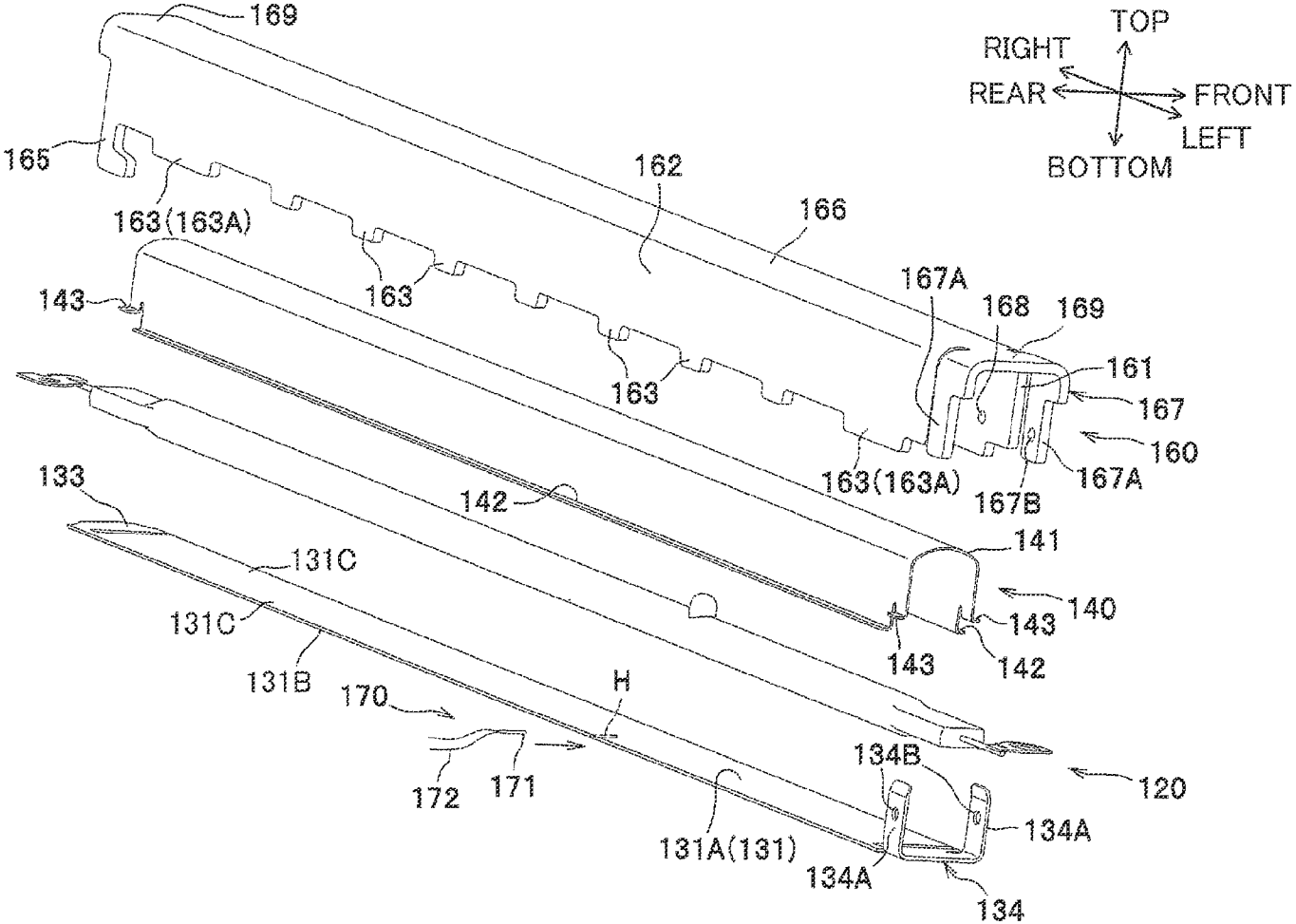
FIG. 3 is an exploded perspective view showing a halogen lamp, a nip plate, a reflection plate, and a stay according to the embodiment.

As shown in FIG. 3, the nip plate 131 has a right end portion provided with an insertion portion 133 extending flat, and a left end portion provided with an engagement portion 134. The engagement portion 134 has U-shaped configuration as viewed from a left side including side wall portions 134A extending upward and formed with engagement holes 134B.

The reflection plate 140 is adapted to reflect radiant heat radiating in the frontward/rearward direction and the upper direction from the halogen lamp 120 toward the nip plate 131 (toward the upper surface 131A of the nip plate 131). As shown in FIG. 2, the reflection plate 140 is positioned within the fusing film 110 and surrounds the halogen lamp 120, with a predetermined distance therefrom. Thus, radiant heat from the halogen lamp 120 can be efficiently concentrated onto the nip plate 131 to promptly heat the nip plate 131 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending outward from each end portion of the reflection portion 141 in the frontward/rearward direction. A mirror surface finishing is available on the surface of the aluminum reflection plate 140 for specular reflection in order to enhance heat reflection ratio. As shown in FIG. 3, two engagement sections 143 are provided at each widthwise (right and left) end of the reflection plate 140. Bach engagement section 143 is positioned higher than the flange portion 142.

As shown in FIG. 2, the pressure roller 150 is positioned below the nip plate 131. The pressure roller 150 is made from a resiliently deformable material. The pressure roller 150 is resiliently deformed to nip the fusing film 110 in cooperation with the nip plate 131 to provide a nip region NP for nipping the sheet P between the pressure roller 150 and the fusing film 110. In other words, the pressure roller 150 presses the nip plate 131 through the fusing film 110 for providing the nip region NP between the pressure roller 150 and the fusing film 110.

The pressure roller 150 is rotationally driven by a drive motor (not shown) disposed in the main frame 2. By the rotation of the pressure roller 150, the fusing film 110 is circularly moved along the nip plate 131 because of a friction force generated therebetween or between the sheet P and the fusing film 110. A toner image on the sheet P can be thermally fixed thereto by heat and pressure during passage of the sheet P at the nip region NP between the pressure roller 150 and the fusing film 110.

The stay 160 is adapted to support the end portions 131C of the nip plate 131 through the flange portion 142 of the reflection plate 140 for maintaining rigidity of the nip plate 131. The stay 160 has a U-shape configuration in conformity with the outer shape of the reflection portion 141 covering the reflection plate 140. For fabricating the stay 160, a highly rigid member such as a steel plate is folded into U-shape to have a top wall 166, a front wall 161 and a rear wall 162. As shown in FIG. 3, each of the front wall 161 and the rear wall 162 has a lower end portion provided with comb-like contact portions 163.

As a result of assembly of the nip plate 131 together with the reflection plate 140 and the stay 160, the comb-like contact portions 163 are nipped between the right and left engagement sections 143. That is, the right engagement section 143 is in contact with the rightmost contact portion 163A, and the left engagement section 143 is in contact with the leftmost contact portion 163A. As a result, displacement of the reflection plate 140 in a rightward/leftward direction (widthwise direction) due to vibration caused by operation of the fixing device 100 can be restrained by the engagement between the engagement sections 143 and the comb-like contact portions 163A.

The front and rear walls 161, 162 have right end portions provided with L-shaped engagement legs 165 each extending downward and then leftward. The insertion portion 133 of the nip plate 131 is insertable into a space between the confronting engagement legs 165 and 165. Further, each end portion 131C of the nip plate 131 is abuttable on each engagement leg 165 as a result of the insertion.

The top wall 166 has a left end portion provided with a retainer 167 having U-shaped configuration. The retainer 167 has a pair of retaining walls 167A whose inner surfaces are provided with engagement bosses 167B each being engageable with each engagement hole 134B.

As shown in FIGS. 2 and 3, each widthwise (left and right) end portion of each of the front wall 161 and the rear wall 162 has an inner surface provided with two abutment bosses 168 protruding inward in abutment with the reflection portion 141 in the frontward/rearward direction. Therefore, displacement of the reflection plate 140 in the frontward/rearward direction due to vibration caused by operation of the fixing device 100 can be restrained because of the abutment of the reflection portion 141 with the bosses 168.

The stay 160 has upper left and right end portions, each provided with a supported portion 169 protruding outward in the rightward/leftward direction. Each of the supported portions 169 is supported to the guide member (not shown).

Assembling procedure of the reflection plate 140 and the nip plate 131 to the stay 160 will be described. First, the reflection plate 140 is temporarily assembled to the stay 160 by the abutment of the outer surface of the reflection portion 141 on the abutment bosses 168. In this case, the engagement sections 143 are in contact with the widthwise endmost contact portions 163A.

Figure 4:
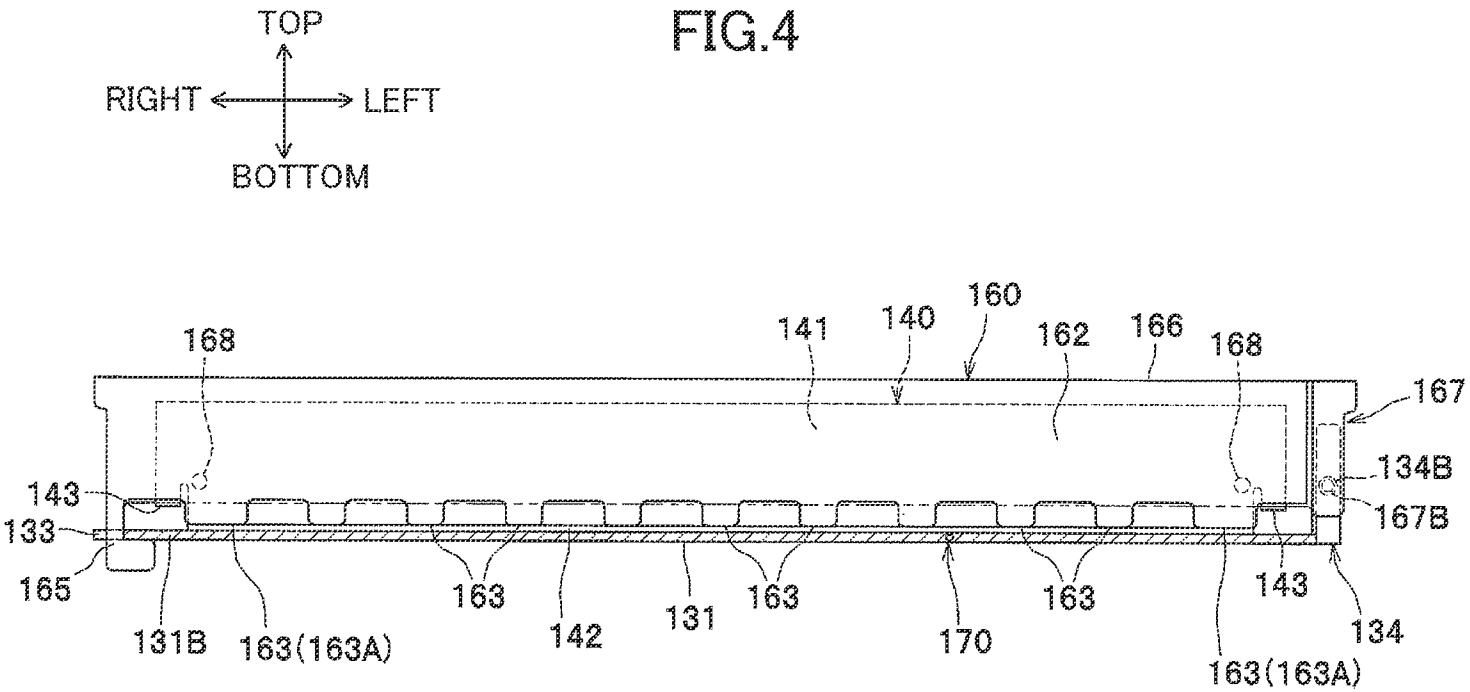
FIG. 4 is a rear view showing an assembled state of the nip plate, the reflection plate and the stay according to the embodiment.

Then, as shown in FIG. 4, the insertion portion 133 is inserted between the engagement legs 165 and 165, so that the base portion 131 can be brought into engagement with the engagement legs 165. Thereafter, the engagement bosses 167B are engaged with the engagement holes 134B. By this engagement, each flange portion 142 is sandwiched between the nip plate 131 and the stay 160. Thus, the nip plate 131 and the reflection plate 140 are held to the stay 160.

Vertical displacement of the reflection plate 140 due to vibration caused by operation of the fixing device 100 can be restrained, since the flange portions 142 are held between the nip plate 131 and the stay 160 as shown in FIG. 2. Thus, position of the reflection plate 140 relative to the nip plate 131 can be fixed.

<Structure of Nip Plate provided with Thermocouple>

As shown in FIGS. 2 and 3, the nip plate 131 is formed with a bottomed hole H allowing a thermocouple 170 as a temperature detection element to be embedded therein. More specifically, the bottomed hole H is formed in a region of the nip plate 131 within a width of the sheet P. The bottomed hole H has an opening formed in a rear edge of the nip plate 131, and extends in a direction parallel to the sheet feeding direction (i.e. the frontward/rearward direction) from the opening into a superposed region of the nip plate 131 superposed with the nip region NP. Note that the superposed region of the nip plate 131 superposed with the nip region NP implies a region in the nip plate 131 superposed with the nip region NP as viewed in the confronting direction such that the nip plate 131 confronts the pressure roller 150.

Figure 5:
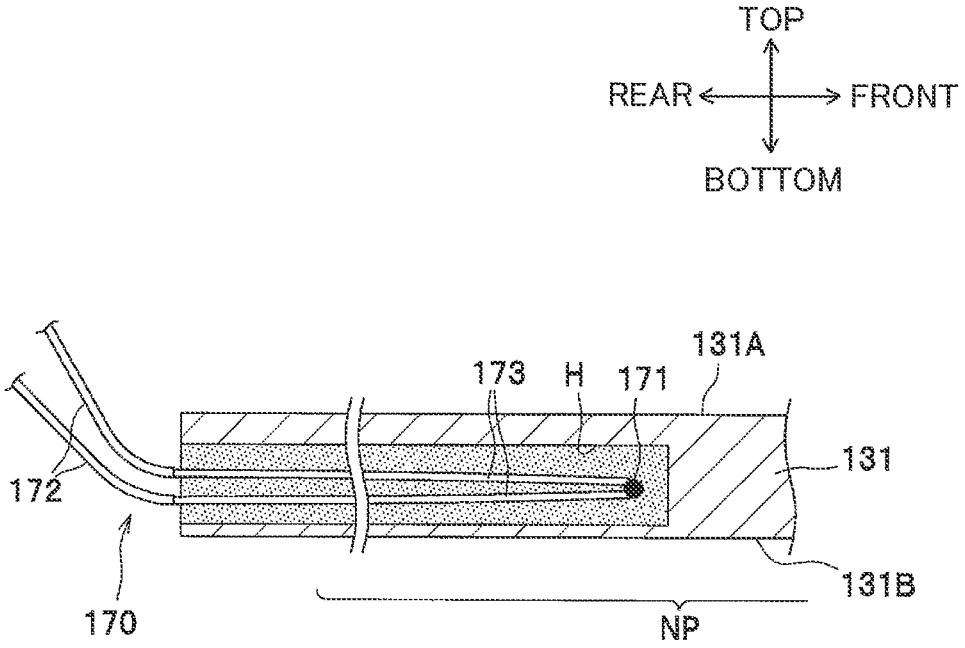
FIG. 5 is a cross-sectional view of the nip plate, in which a thermocouple is embedded according to the embodiment.

As shown in FIG. 5, the bottomed hole H has an axis extending in the frontward/rearward direction, and the axis is provided at a position closer to the lower surface 131B than to the upper surface 131A in the confronting direction. That is, the axis of the bottomed hole H is displaced from a center of a thickness of the nip plate 131 in the confronting direction downward toward the lower surface 131B. Incidentally, it is preferable that the bottomed hole H has a diameter less than or equal to a length of 60 percent on the thickness of the nip plate 131, in order to reduce manufacturing defects.

The thermocouple 170 serves to detect a temperature of the superposed region of the nip plate 131 superposed with the nip region NP. The thermocouple 170 includes a junction 171 and a pair of bared wires 173. Each of the bared wires 173 includes a coated portion 172 coated by a thermally insulation material. That is, the junction 171, the pair of bared wires 173, and the coated portions 172 constitute the thermocouple 170.

One of the bared wires 173 is formed of a metal different from that of remaining one of the bared wires 173. The junction 171 is provided such that an end portion of the one of the bared wires 173 is connected to an end portion of the remaining one of the bared wires 173. The junction 171 and the pair of bared wires 173 except the coated portions 172 are positioned in the bottomed hole H. That is, the coated portions 172 are positioned outside of the bottomed hole H.

More specifically, the thermocouple 170 is embedded in the bottomed hole H so that the junction 171 is positioned within the superposed region of the nip plate 131 superposed with the nip region NP. The bottomed hole H into which the thermocouple 170 (the junction 171 and the bared wires 173) is embedded is filled with an adhesive agent such as a heat-resistant epoxy resin adhesive agent.

Because the axis of the bottomed hole H is displaced from the center of the thickness of the nip plate 131 toward the lower surface 131B, the junction 171 and the pair of bared wires 173 embedded in the bottomed hole H are also displaced from the center of the thickness of the nip plate 131 downward toward the lower surface 131B. The pair of bared wires 173 is disposed in the bottomed hole H so as to extend in the sheet feeding direction (the frontward/rearward direction) from the superposed region of the nip plate 131 superposed with the nip region NP toward outside of the nip plate 131. The thermocouple 170 (the junction 171 and the pair of bared wires 173) is positioned closer to the lower surface 131B than to the upper surface 131A in the confronting direction. Hence, when the thermocouple 170 detects the temperature of the superposed region of the nip plate 131 superposed with the nip region NP, influence of the radiant heat transmitted to the nip plate 131 from the halogen lamp 120 relative to the thermocouple 170 can be minimized. As a result, a temperature of the nip region NP can be accurately measured.

In the present embodiment, it is preferable that portions of the thermocouple 170 embedded in the bottomed hole H (i.e. the junction 171 and the pair of the bared wires 173) have a vertical length smaller than the thickness of the nip plate 131 in the confronting direction. If the thermocouple 170 is designed to have the vertical length smaller than the thickness of the nip plate 131, the thermocouple 170 can be embedded in the nip plate 131 so as to be positioned between the upper surface 131A and the lower surface 131B. Thus, the upper surface 131A and the lower surface 131B are formed to be flat without a projecting portion for accommodating the thermocouple 170 therein. Further, because the upper surface 131A and the lower surface 131B are flat, the nip plate 131 can be uniformly heated by the halogen lamp 120.

As a heat capacity of the nip plate 131 reduces, a thermal responsiveness can be increased, thereby enhancing heat efficiency. Therefore, it is preferable that the nip plate 131 is formed as thin as possible, as long as a sufficient nip force can be generated. For example, the thickness of the nip plate 131 is preferably less than or equal to 1.5 mm. More preferably, the thickness of the nip plate 131 is less than or equal to 1.0 mm. Since the thermocouple 170 is embedded in the nip plate 131 having such a thinness, it is preferable that the thermocouple 170 has the vertical length less than or equal to 0.5 mm.

In FIG. 5, the bared wires 173 are delineated so that the one of the bared wires 173 is positioned above the remaining one of the bared wires 173 in the confronting direction, for the sake of simplicity. However, it is preferable that the one of the bared wires 173 and the remaining one of the bared wires 173 are aligned in a direction parallel to the upper surface 131A of the nip plate 131 (i.e. a direction perpendicular to the confronting direction, for example, the rightward/leftward direction in FIG. 5). In the latter case, the vertical length of the thermocouple 170 is smaller than that of the thermocouple 170 in the former case. Accordingly, the vertical length of the thermocouple 170 can be easily reduced to smaller than the thickness of the nip plate 131. As a result, the thermocouple 170 can be easily inserted into the bottomed hole H.

Each of the bared wires 173 has another end portion connected to a temperature control device (not shown). Hence, a measurement result of the temperature of the nip plate 131 by the thermocouple 170 can be transmitted to the temperature control device, thereby controlling the temperature of the nip plate 131.

The fixing device 100 according to the above-described embodiment provides the following advantages and effects: The thermocouple 170 is embedded in the bottomed hole H formed in the nip plate 131. Thus, no attachment is required to fix the thermocouple 170 to the nip plate 131. Further, the thermocouple 170 is provided inside of the nip plate 131. Hence, during a printing operation, damage of the fusing film 110 caused by the thermocouple 170 can be avoided. Still further, the junction 171 is positioned at the superposed region of the nip plate 131 superposed with the nip region NP. Accordingly, the thermocouple 170 can accurately measure the temperature of the nip region NP in which toner is thermally fixed onto the sheet P.

The thermocouple 170 is displaced downward toward the lower surface 131B from the center of the thickness of the nip plate 131 in the confronting direction. That is, in the confronting direction, the thermocouple 170 is positioned in the nip plate 131 so as to be closer to the lower surface 131B than to the upper surface 131A that receives the radiant heat from the halogen lamp 120. Hence, when the thermocouple 170 detects the temperature of the nip plate 131, influence of the radiant heat from the halogen lamp 120 relative to the thermocouple 170 can be reduced. Consequently, the thermocouple 170 can measure a temperature closer to the temperature of the nip region NP.

Various modifications are conceivable.

Figure 6:
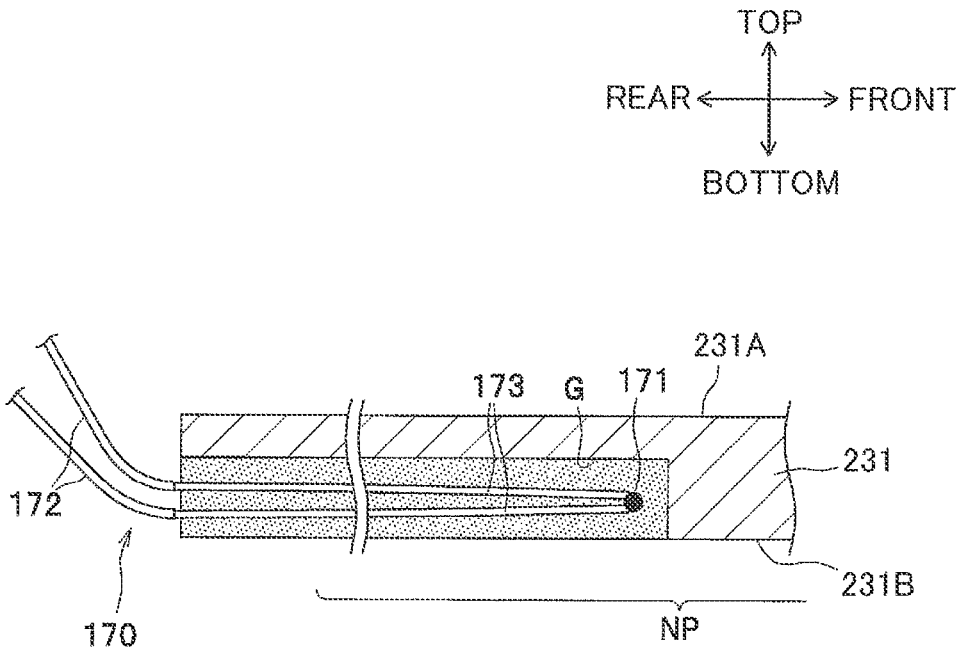
FIG. 6 is a cross-sectional view of a nip plate according to a modification.

In the above depicted embodiment, the thermocouple 170 is embedded in the bottomed hole H formed in the nip plate 131. However, for example, as shown in FIG. 6, a groove G can be formed in a lower surface 231B of a nip plate 231. The groove G extends in a direction parallel to the sheet feeding direction (the frontward/rearward direction) from the rear edge of the nip plate 231 into the superposed region of the nip plate 231 superposed with the nip region NP. The thermocouple 170 is embedded in the groove G, and the groove G in which the thermocouple 170 is embedded is filled with the adhesive agent. The adhesive agent is filled in the groove G so as to be in flush with the lower surface 231B.

Since the groove G is formed not in an upper surface 231A but in the lower surface 231B, the thermocouple 170 embedded in the groove G is positioned closer to the lower surface 231B than to the upper surface 231A in the confronting direction. As a result, influence of the radiant heat transmitted to the nip plate 131 from the halogen lamp 120 relative to the thermocouple 170 can be reduced. Further, compared to the case where the bottomed hole H is formed in the nip plate 131, a position of the thermocouple 170 to be embedded in the groove G can be visually confirmed. Therefore, the thermocouple 170 can be embedded at an accurate position in the groove G.

Figure 7:
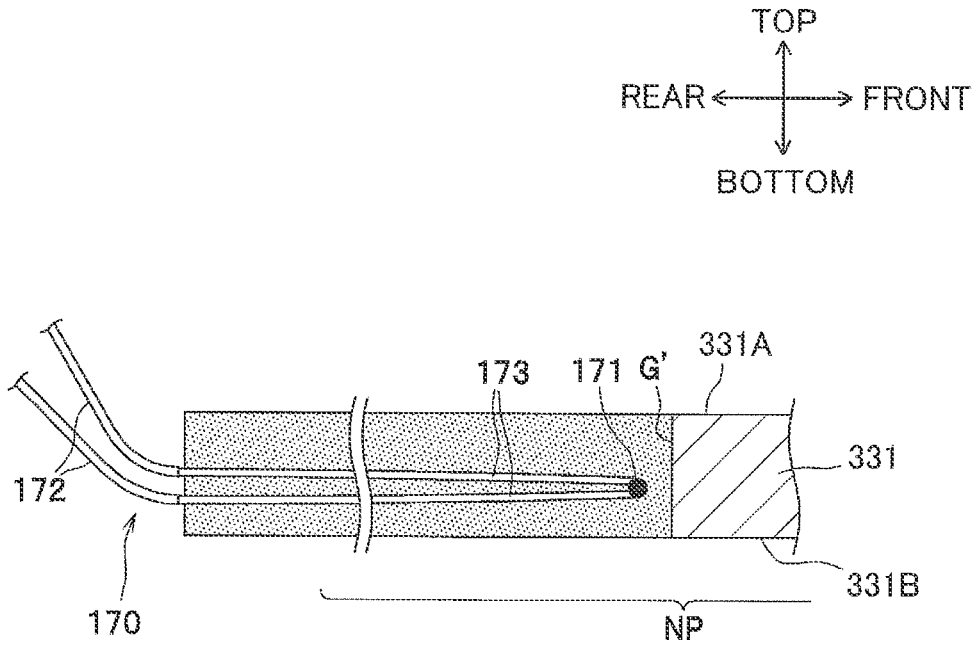
FIG. 7 is a cross-sectional view of a nip plate according to another modification.

The portion in which the thermocouple 170 is accommodated is not limited to a hole or a groove. Alternatively, as shown in FIG. 7, a nip plate 331 can be formed with a notched portion G' penetrating through the thickness of the nip plate 331 in the confronting direction and opening to an upper surface 331A and a lower surface 131B and extending in a direction parallel to the sheet feeding direction (the frontward/rearward direction) from the rear edge of the nip plate 331 into the superposed region of the nip plate 331 superposed with the nip region NP. The thermocouple 170 is accommodated in the notched portion G', and the notched portion G' in which the thermocouple 170 is accommodated is filled with the adhesive agent. The adhesive agent is filled in the notched portion G' so as to be in flush with the upper surface 331A and the lower surface 331B.

The bottomed hole H, the groove G, and the notched portion G' are formed so as to extend frontward from the rear edge of the nip plate 131 (231, 331). However, the bottomed hole H, the groove G, and the notched portion G' can be formed so as to extend rearward from a front edge of the nip plate 131 (231, 331). Alternatively, the bottomed hole H, the groove G, and the notched portion G' can be formed so as to extend in the rightward/leftward direction. Instead of extending from the front edge or the rear edge, the bottomed hole H, the groove G, and the notched portion G' can be formed only within the superposed region of the nip plate 131 (231, 331) superposed with the nip region NP.

In the above depicted embodiment, the adhesive agent is employed to fill in the bottomed hole H (the groove G and the notched portion G') in which the thermocouple 170 is accommodated. However, instead of the adhesive agent, solder is available.

In the above depicted embodiment, the thermocouple 170 is employed as the temperature detection element. However, a temperature sensor, such as a thermistor, is available.

While the invention has been described in detail with reference to the embodiment thereof, it would be apparent to those skilled in the art that various changes and modifications may be made therein without departing from the spirit of the invention.

What is claimed is:

1. A fixing device for thermally fixing a developing agent image to a sheet fed in a sheet feeding direction comprising:

a tubular flexible fusing member having an inner peripheral surface defining an internal space;

a heater disposed in the internal space;

a nip member disposed in the internal space, the inner peripheral surface of the tubular flexible fusing member being in contact with the nip member;

a backup member configured to provide a nip region in cooperation with the tubular flexible fusing member upon nipping the tubular flexible fusing member between the backup member and the nip member, the backup member facing the nip member in a facing direction; and a temperature detection element disposed in a superposed region of the nip member superposed with the nip region in the facing direction and configured to detect a temperature of the superposed region, wherein the nip member is formed of a plate member having a thickness in the facing direction and formed with a hole extending in the sheet feeding direction, the nip member having a first surface in direct confrontation with the heater and a second surface in confrontation with the backup member via the tubular flexible fusing member, and the hole being spaced away from the first surface and the second surface, wherein the temperature detection element has a length in the facing direction smaller than that of the nip member, the temperature detection element being embedded in the hole.

2. The fixing device as claimed in claim 1, wherein the temperature detection element is positioned closer to the second surface than to the first surface in the facing direction.

3. The fixing device as claimed in claim 1, wherein the temperature detection element comprises a thermocouple including a junction and a pair of bared wires connected to the junction.

4. The fixing device as claimed in claim 3, further comprising a stay disposed in the internal space and configured to support the nip member, wherein the pair of bared wires is disposed between the tubular flexible fusing member and the stay.

5. The fixing device as claimed in claim 3, wherein one of the pair of bared wires is made of a material different from a material which the other one of the pair of bared wires is made.

6. The fixing device as claimed in claim 1, wherein the hole is filled with an adhesive agent.

7. The fixing device as claimed in claim 1, wherein the nip member has a downstream end portion in the sheet feeding direction, the temperature detection element being disposed in the downstream end portion.

8. The fixing device as claimed in claim 1, wherein the nip member has an elongated shape extending in an elongated direction, the temperature detection element being disposed at a center portion of the nip member in the elongated direction.

* * * * *